United States Patent [19]

Barry

[11] 4,131,228

[45] Dec. 26, 1978

[54] BOTTOM FOR BULK BINS

[75] Inventor: Edward J. Barry, Creve Coeur, Mo.

[73] Assignee: International Paper Company, New York, N.Y.

[21] Appl. No.: 826,466

[22] Filed: Aug. 22, 1977

[51] Int. Cl.[2] ..... B65D 13/00

[52] U.S. Cl. ..... 229/23 R; 229/43

[58] Field of Search ..... 229/23 R, 41 C, 43, 229/39

[56] References Cited

U.S. PATENT DOCUMENTS

| | | | |
|---|---|---|---|
| 1,130,236 | 3/1915 | Adams | 229/23 A |
| 1,856,931 | 5/1932 | Scott | 229/23 R |
| 2,459,727 | 1/1949 | Tillery | 229/23 A |
| 2,459,728 | 1/1949 | Tillery | 229/23 A |
| 2,476,583 | 7/1949 | Burgoon | 229/23 R X |
| 2,483,063 | 9/1949 | Ray | 229/43 |
| 2,874,889 | 2/1959 | Hale | 229/23 R |
| 2,944,725 | 7/1960 | Hayes | 229/43 |
| 3,000,496 | 9/1961 | Larson | 229/41 C |
| 3,214,076 | 10/1965 | Gagnon | 229/23 R |
| 3,526,352 | 9/1970 | Swett | 229/39 R |
| 3,666,164 | 5/1972 | Nederveld | 229/23 R |
| 3,945,558 | 3/1976 | Elder | 229/23 R |

FOREIGN PATENT DOCUMENTS

| | | | |
|---|---|---|---|
| 402436 | 12/1933 | United Kingdom | 229/23 R |

*Primary Examiner*—Davis T. Moorhead

*Attorney, Agent, or Firm*—Ronald A. Schapira

[57] ABSTRACT

A paperboard bulk bin for heavy palletized loads of meat and the like, which includes a side wall that is formed by a plurality of alternating, foldably connected, substantially rectangular, upstanding side panels and corner panels; each of the side panels having a horizontally disposed, substantially rectangular flap, foldably connected to its bottom edge; each of the corner panels having a horizontally disposed, four-sided, tapered flap, foldably connected to its bottom edge and positioned atop adjacent rectangular flaps; and each of the tapered flaps and rectangular flaps being foldably connected to a triangular gusset panel, horizontally disposed between them. The bulk bin is provided with an improved pad, forming the bottom of the bin, which is unscored, unfolded, generally rectangular, substantially planar, and substantially rigid. The bottom pad includes two pairs of parallel slots, extending from opposite side edges thereof, with the pairs of slots being substantially aligned. The foldable connections between each of two rectangular flaps, on opposite sides of the bin, and the pairs of triangular gusset panels, about each of the two rectangular flaps, are disposed within the slots of the bottom pad, so that the portions of the bottom pad, between each pair of parallel slots, are between one of the two rectangular flaps and its foldably connected pair of triangular gusset panels.

11 Claims, 12 Drawing Figures

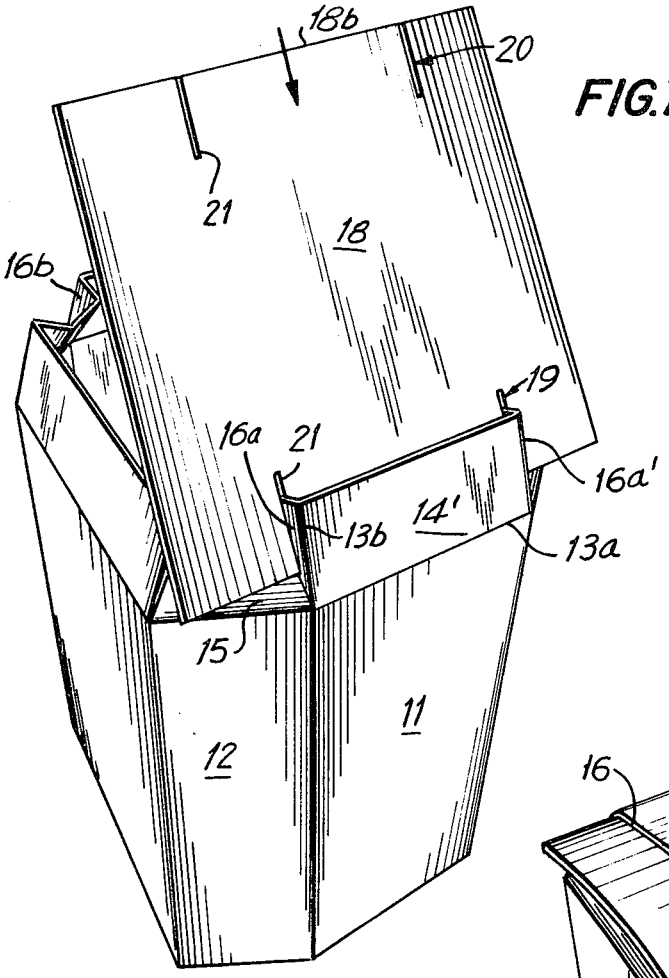
FIG.7
FIG.8
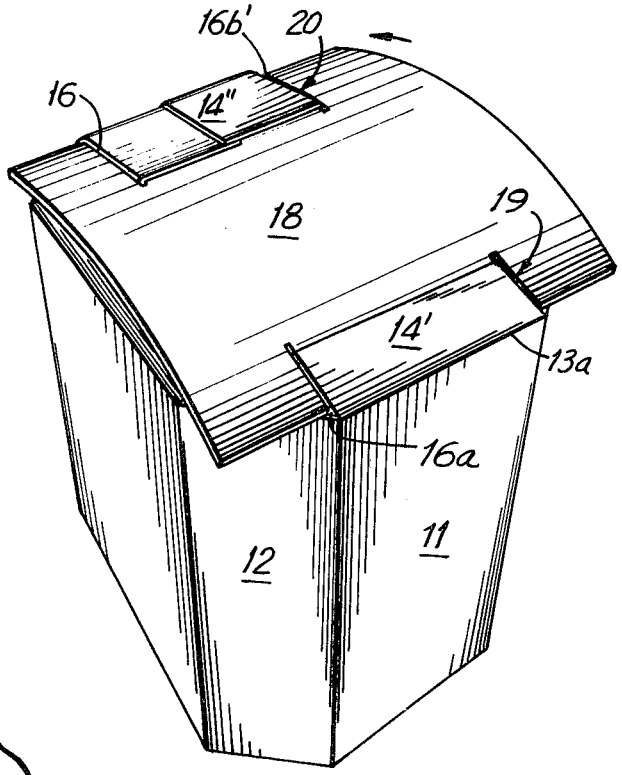
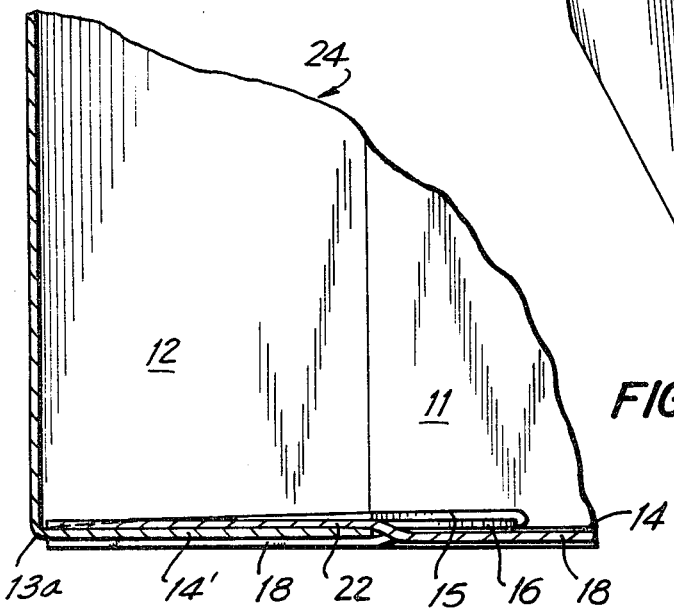
FIG.12

BOTTOM FOR BULK BINS

BACKGROUND OF THE INVENTION

This invention relates to a paperboard bulk bin for relatively heavy quantities of cut-up meat and the like. This invention is particularly concerned with a bin for relatively heavy, palletized loads which are to be moved from place to place. This invention is also particularly concerned with a bin which has a flat bottom and which will not be prone to tip-over or break-apart when the relatively heavy, palletized load is in motion or is brought to a sudden stop. This invention is quite particularly concerned with bins for use in centralized meat-cutting operations.

Centralized meat-cutting operations, involving the mechanized cutting-up, packaging and shipping of large quantities of fresh meat, have required a heavy duty, bulk bin that can be easily formed, filled and moved from place to place on a pallet. In order to be satisfactory for use in a centralized meat-cutting operation, the bin has had to be designed to hold relatively large quantities of meat, on the order of about 2,000 pounds. The bin also has had to be rugged enough to withstand abuse during its handling and moving from place to place on a pallet in the centralized meat-cutting operation. The bin further has had to be adapted to being quickly and easily set-up, preferably by a single workman, at the site of the centralized meat-cutting operation from a generally tubular blank or cylinder.

An example of a bulk pin, suitable for centralized meat-cutting operations, is described in U.S. Pat. No. 3,945,558, issued March 23, 1976, to Mr. Jerome E. Elder. However, some problems have arisen in the use of the bin of U.S. Pat. No. 3,945,558. In particular, certain difficulties have been encountered in having the bin assembled by one workman, e.g., in properly aligning a bottom wall insert or pad in the bottom of the bin and in maintaining the generally tubular configuration of the bin during its assembly and prior to its being filled.

SUMMARY OF THE INVENTION

In accordance with this invention, in a paperboard bulk bin, provided with: a side wall formed from a plurality of alternating, foldably connected, substantially rectangular, upstanding side panels and corner panels; each of said side panels having a horizontally disposed, substantially rectangular flap, foldably connected to the bottom edge thereof; each of said corner panels having a horizontally disposed, four-sided, tapered flap, foldably connected to the bottom edge thereof and positioned atop adjacent rectangular flaps; and each of said tapered flaps and rectangular flaps being foldably connected to a triangular gusset panel, horizontally disposed between them; the improved bottom pad which comprises:

an unscored, unfolded, generally rectangular, substantially planar, substantially rigid member, having two pairs of parallel slots, extending from opposite side edges thereof;

said pairs of slots being substantially aligned; and the foldable connections between each of two rectangular flaps, on opposite sides of the bin, and the pairs of triangular gusset panels, about each of said two rectangular flaps, being disposed within said slots of said bottom pad, so that the portions of said bottom pad, between each pair of said parallel slots, are between one of said two rectangular flaps and its foldably connected pair of triangular gusset panels.

In accordance with another aspect of this invention, a paperboard blank is provided which can form the bottom pad of the bulk bin and which comprises:

an unscored, unfolded, generally rectangular, substantially planar, substantially rigid member, having two pairs of parallel slots, extending from opposite side edges thereof;

said pairs of slots being substantially aligned.

By the improved constructions of this invention for a paperboard bulk bin and for a blank for the bottom pad of a bin, a bulk bin for relatively heavy loads of meat and the like is provided which is strong, which has a flat bottom and can stand stably on a moving pallet without tipping-over or bursting, and which can be more easily and rapidly assembled by a single workman for use in a centralized meat-cutting operation.

DESCRIPTION OF THE DRAWINGS

FIG. 7 is a perspective view of the bottom pad of FIG. 2 and the cylinder of FIG. 5, after carrying out a first step for placing the pad in the cylinder to form the bulk bin of this invention. In FIG. 7, at least a part of each of the two triangular gusset panels, foldably connected to a first rectangular flap, along the edge of the cylinder of FIG. 5, has been inserted in one of two pairs of parallel slots in the bottom pad.

FIG. 8 is a perspective view of the bottom pad of FIG. 2 and the cylinder of FIG. 5, after carrying out a second step for placing the pad in the cylinder. In FIG. 8, at least a part of each of the two triangular gusset panels, foldably connected to a second rectangular flap, along the edge of the cylinder and on the opposite side of the cylinder from the first rectangular flap, has been inserted in the other pair of parallel slots in the bottom pad.

In FIG. 9, the bottom pad has been urged inwardly of the cylinder, so that substantially all of the foldable connections between the first and second rectangular flaps, on opposite sides of the cylinder, and the pairs of triangular gusset panels, about the first and second rectangular flaps, are disposed within the two pairs of slots in the bottom pad.

FIG. 12 is a fragmentary sectional view, taken along line 12—12 in FIG. 11.

DETAILED DESCRIPTION OF THE INVENTION

Figure 1:
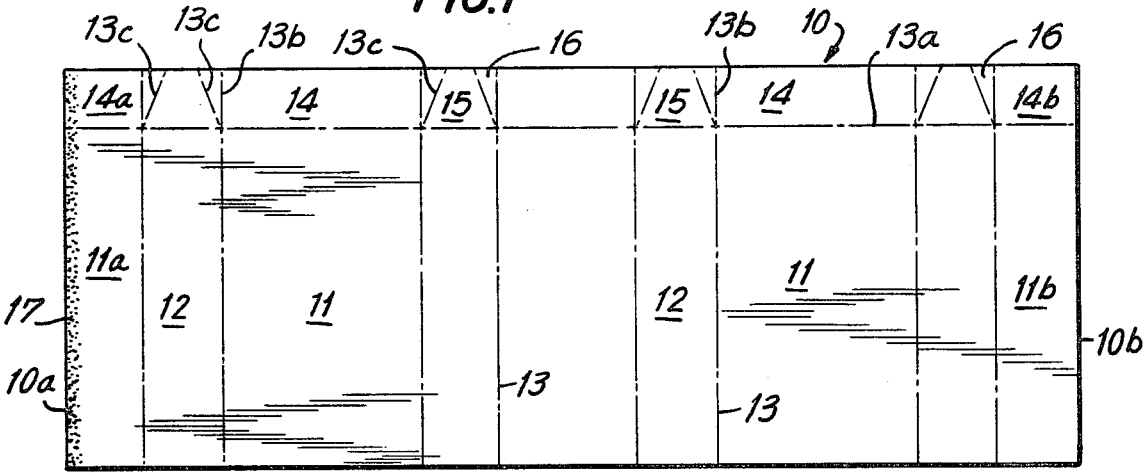
FIG. 1 is a plan view of a paperboard blank which can be formed into the side wall of the bulk bin of this invention.

Shown in FIG. 1 is a paperboard blank, generally 10, which can be formed into the side wall of the bulk bin of this invention. The side wall blank 10 includes a plurality of alternating, substantially rectangular, side panels 11 and corner panels 12 and a plurality of scored fold lines, generally 13. The side panels 11 and corner panels 12 are foldably connected along a plurality of the fold lines 13 between the side and corner panels 11 and 12. Foldably connected to one edge of each of the side panels 11 is a substantially rectangular flap 14, and foldably connected to one edge of each corner panel 12 is a four-sided, tapered flap 15. The rectangular flaps 14 and tapered flaps 15 are foldably connected to their respective side panels 11 and corner panels 12 along a single scored fold line 13*a*.

For purposes of this Description, the edge of each panel 11 and 12, along fold line 13*a*, will be considered as the widthwise edge thereof, and the edge of each flap 14 and 15, along fold line 13*a*, will be considered as the lengthwise edge thereof. Hence, in the side wall blank 10, the width of each side panel 11 equals the length of each rectangular flap 14, and the width of each corner panel 12 equals the length of each tapered flap 15.

The rectangular flaps 14 and tapered flaps 15 are also foldably connected to triangular gusset panels 16. Each of the rectangular flaps 14 is connected to a triangular gusset panel 16 along a scored fold line 13*b*, which defines the width of the rectangular flap 14. Likewise, each of the tapered flaps 15 is foldably connected to a triangular gusset panel 16 along an angled scored fold line 13*c*. The fold lines 13*b* and 13*c* of each triangular gusset panel 16 intersect at a point, along fold line 13*a*, where the fold lines 13, separating the side panels 11 and corner panels 12, intersect fold line 13*a*.

The side wall blank 10 can, if desired, also be provided with an adhesive pattern 17 on one or more surface portions thereof, adjacent a width-wise edge 10*a* thereof. The adhesive pattern 17 can be provided on either a side panel 11 and rectangular flap 14 or on a corner panel 12 and tapered flap 15. As shown in FIG. 1, the edge portion of the side wall blank 10, containing the adhesive pattern 17, is an edge portion of half of a side panel 11 and of half of a rectangular flap 14. The half 11*a* of the halved side panel 11 and the half 14*a* of the halved rectangular flap 14, containing the adhesive pattern 17, are located at one end of the blank 10, adjacent widthwise blank edge 10*a*. The other half 11*b* of the halved side panel 11 and the other half 14*b* of the halved rectangular flap 14 are located adjacent the opposite widthwise edge 10*b* of the side wall blank 10. When the adhesive pattern 17 on one end of the side wall blank 10 is attached to the other end of the blank 10, as shown in FIG. 3, a full-sized side panel 11 and rectangular flap 14 are obtained, having a double thickness where the two half side panels 11*a* and 11*b* and the two half rectangular flaps 14*a* and 14*b* are overlapped.

Figure 3:
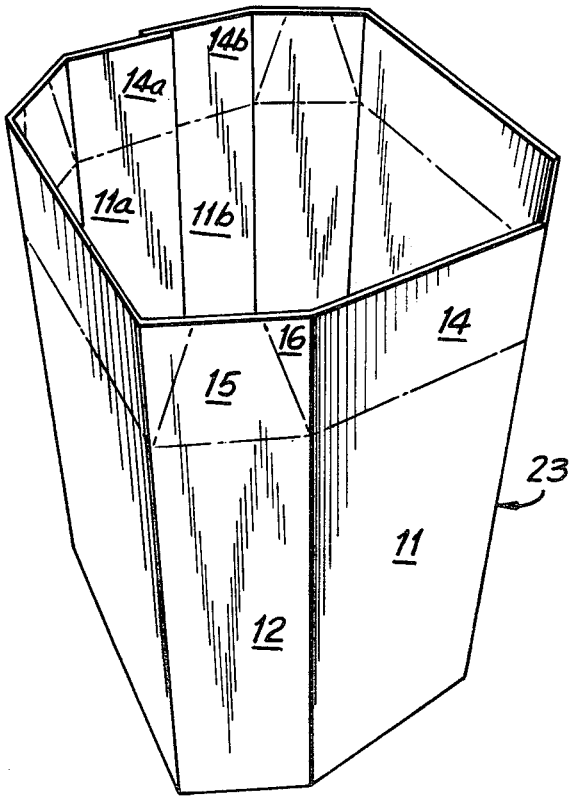
FIG. 3 is a perspective view of a generally tubular cylinder, formed by side seaming the blank of FIG. 1.

In the side wall blank 10 of FIG. 1, the side panels 11 and the half side panels 11*a* and 11*b*, when attached as in FIG. 3, should have substantially the same dimensions, the corner panels 12 should have substantially the same dimensions, the rectangular flaps 14 and the half rectangular flaps 14*a* and 14*b*, when attached as in FIG. 3, should have substantially the same dimensions, the tapered flaps 15 should have substantially the same dimensions, and the triangular gusset panels 16 should have substantially the same dimensions. Also in the side wall blank 10, there should be an even number, i.e., 2, 4, 6, 8, etc., of each side and corner panel 11 and 12 and rectangular and tapered flap 14 and 15 and twice the number, i.e., 4, 8, 12, 16, etc., of gusset panels 16.

Figure 2:
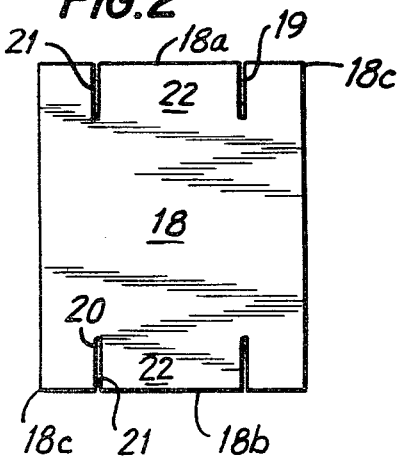
FIG. 2 is a plan view of a paperboard blank which can form a bottom pad for the bulk bin of this invention.

Shown in FIG. 2 is a paperboard blank, generally 18, which can form the bottom wall or bottom pad 18 of the bulk bin of this invention. The bottom pad 18 is an unscored, unfolded, generally rectangular, substantially planar, substantially rigid member. The bottom pad 18 has a first and second pair 19 and 20 of parallel slots 21, extending from opposite, first and second side edges 18*a* and 18*b* of the bottom pad 18. The parallel slots 21 in the first pair 19 of slots are aligned, i.e., colinear, with the parallel slots 21 in the second pair 20 of slots.

In bottom pad 18, the width of the slots 21 is not critical. Preferably, the slots 21 are at least as wide as the thickness of the paperboard material, from which the side wall blank 10 is made, e.g., $\frac{1}{8}$ to $\frac{1}{2}$ inch, preferably about $\frac{1}{4}$ to $\frac{3}{8}$ inch.

In bottom pad 18, the length of the slots 21 also is not critical. Preferably, the length of the slots 21 and hence the width of the portions 22 of the bottom pad 18, between the slots 21 in each pair 19 and 20 of slots, are at least equal to, especially about equal to, the length of each foldable connection between a rectangular flap 14 and a triangular gusset panel 16, i.e., the length of a scored fold line 13*b*.

However, the separation of the parallel slots 21 in each of the two pairs 19 and 20 of slots in the bottom pad 18 is very important. The separation of the parallel slots 21 in each pair 19 and 20 of slots and hence the length of the portions 22 of the bottom pad 18, between the slots 21 in each pair 19 and 20 of slots, should be equal to the length of a rectangular flap 14, i.e., equal to the distance between the triangular gusset panels 16 or the distance between the fold lines 13*b* about a rectangular flap 14. Thereby, both of the fold lines 13*b*, between any rectangular flap 14 and the pair of gusset panels 16 about it, can be suitably provided in one of the pairs 19 and 20 of slots in the bottom pad 18, when forming the bulk bin of this invention.

The side wall blank 10 and bottom pad blank 18 of this invention can be formed of any paperboard material conventionally utilized in bulk bins. In general, the selection of a particular thickness and weight of paperboard material for side wall and bottom pad blanks 10 and 18 will depend upon the weight and quantity of material to be held in the bulk bin. For loads of cut-up meat and the like weighing up to about 2,000 pounds, it is preferred that the blanks 10 and 18 be formed from a single wall, corrugated board, such as a board having a thickness of about 0.177 inch and a weight of about 210 lbs./1000 sq. ft., or a double wall, corrugated board, such as a board having a thickness of about 0.325 inch and a weight of about 240 lbs./1000 sq. ft. The particularly preferred paperboard materials for the blanks 10 and 18 are the double wall, corrugated boards. If desired, one or both surfaces of the blanks 10 and 18 can be coated with a film of a barrier material, such as a moisture barrier material. Among the barrier materials, which can be suitably utilized, are the polyolefins, such as polyethylene and polypropylene, and saran. Preferably, the paperboard material utilized in the blanks 10 and 18 is a water resistant material, and no additional barrier material is utilized on its surface.

In the side wall blank 10, shown in FIG. 1, certain proportions of its members are considered critical to assure that the resulting bulk bin will stand stably on a pallet, when filled with up to about 2,000 pounds of meat and the like, and to assure that the bulk bin and its flaps and panels will not be damaged during use of the loaded bin. In this regard, it is considered necessary that the rectangular flaps 14, tapered flaps 15 and triangular gusset panels 16 be so proportioned that they can be properly disposed perpendicular to the side panels 11 and corner panels 12 and substantially horizontal in the bulk bin, formed from the side wall blank 10. For this purpose, it is believed essential that: the included angle in each triangular gusset panel 16, between the rectangular flaps 14 and tapered flaps 15, i.e., between fold lines 13*b* and 13*c*, be equal to about 180° divided by the number of triangular gusset panels 16 in the side wall blank 10; and that the length of each tapered flap 15, as measured along fold line 13*a*, be equal to or greater than twice the width of the rectangular flaps 14, as measured along fold line 13*b*, times the cosine of [90° minus twice the angle in the triangular gusset panels 16 included between the rectangular flaps 14 and tapered flaps 15, i.e., 90° minus twice the angle between fold lines 13*b* and 13*c*]. When these conditions are met in the side wall blank 10, the resulting bulk bin can be used as intended.

The side wall blank 10, in FIG. 1, is shown as preferably having four side panels 11, four corner panels 12, four rectangular flaps 14, four tapered flaps 15 and eight gusset panels 16. The included angle in each gusset panel 16, between the flaps 14 and 15, is about 180°/8 or about 22½°. The corresponding bottom pad blank 18, in FIG. 2, is shown as preferably having four sides. However, the blanks 10 and 18, for forming a bulk bin in accordance with this invention, are not limited to these preferred configurations. In fact, the side wall blank 10 can, if desired, suitably include as few as two or as many as six, eight, ten or more, side panels 11, corner panels 12, rectangular flaps 14, and tapered flaps 15. Likewise, the bottom pad blank 18 can suitably have its corner portions 18*c* beveled, so that it has as many as eight or twelve sides, corresponding to the total number of side and corner panels 11 and 12 in the side wall blank 10.

In the side wall blank 10 of FIG. 1, the side panels 11 are shown as substantially wider than the corner panels 12. Such proportions are not required in the side wall blank 10 in accordance with this invention. However, the eight side and corner panels 11 and 12 and corresponding eight rectangular and tapered flaps 14 and 15 and sixteen gusset panels 16 of the side wall blank 10 of FIG. 1, wherein the side panels 11 are substantially wider than the corner panels 12, in combination with the square bottom pad blank 18 of FIG. 2, wherein the slots 21 in each pair 19 and 20 of slots are separated by the width of a side panel 11, i.e., the length of a rectangular flap 14, provide a preferred, bulk bin, which has a substantially square cross-section and is adapted to occupy the minimum amount of space on a pallet.

Shown in FIG. 3 is a generally tubular blank or cylinder, generally 23, formed by side seaming the side wall blank 10 along its widthwise edges 10*a* and 10*b*. The side and corner panels 11 and 12 of the cylinder 23 are adapted to form an eight-sided side wall of the bulk bin of this invention. As seen in FIG. 3, the cylinder 23 is assembled by bonding the two side panel halves 11*a* and 11*b* and the two rectangular flap halves 14*a* and 14*b*, adjacent the widthwise edges 10*a* and 10*b* of the side wall blank 10. For this purpose, the adhesive pattern 17 on the side wall blank 10, adjacent a first widthwise edge 10*a* of the blank 10, can be bonded to the portion of the side wall blank 10 adjacent its opposite widthwise edge 10*b*. Preferably, the two side panel halves 11*a* and 11*b* and the two rectangular flap halves 14*a* and 14*b*, adjacent the widthwise edges 10*a* and 10*b* of the side wall blank 10, are stapled together, either with or without the use of the adhesive pattern 17. The use of staples, in side seaming the blank 10, assures a strong bond between the opposite widthwise edges of the blank 10. For this purpose, any conventional strong staples can be utilized. It is especially preferred that the edges 10*a* and 10*b* of the blank 10 be adhered with both staples for strength and an adhesive pattern 17 for added strength and for sealant purposes.

Figure 4:
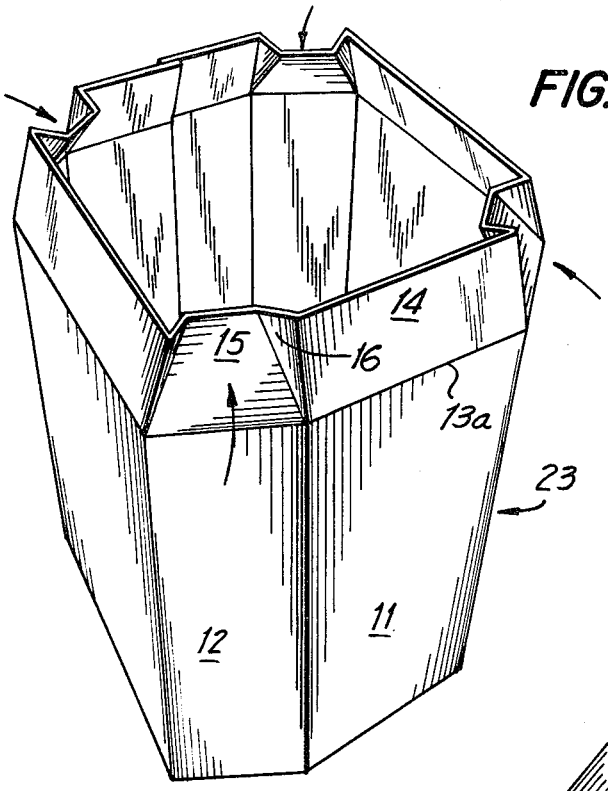
FIG. 4 is a perspective view of the cylinder of FIG. 3, in which the flaps, provided along an edge of the cylinder, have been urged somewhat inwardly of the cylinder.
Figure 5:
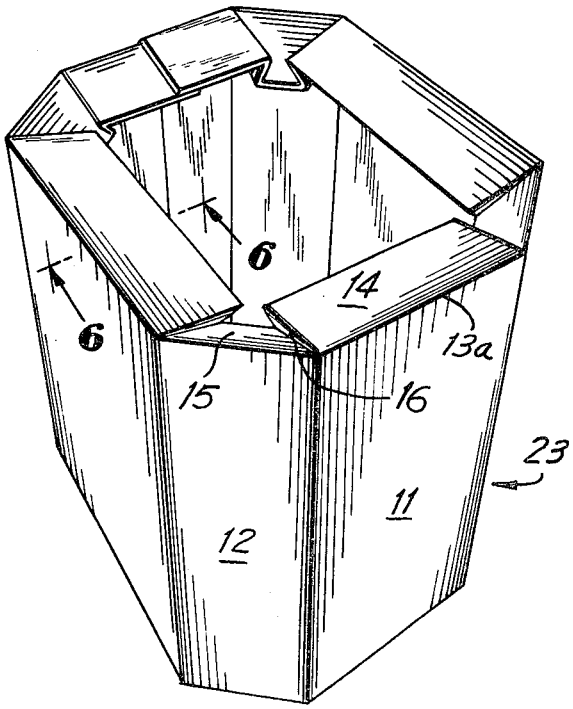
FIG. 5 is a perspective view of the cylinder of FIGS. 3 and 4, in which the flaps, provided along an edge of the cylinder, have been urged inwardly of the cylinder, so that the free edges thereof are positioned interiorly of the cylinder.
Figure 6:
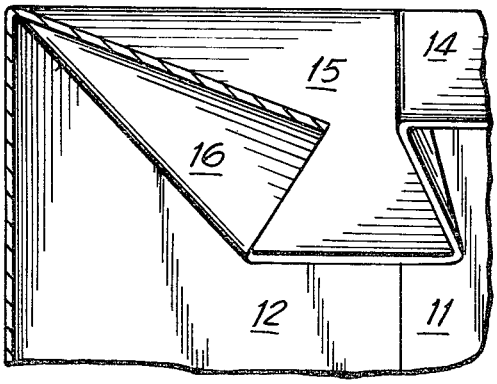
FIG. 6 is a fragmentary sectional view, taken along line 6—6 in FIG. 5.

Shown in FIGS. 4, 5 and 6 is the preparation of the cylinder 23 for the insertion of the bottom pad 18 to form the bulk bin of this invention. In FIG. 4, the rectangular and tapered flaps 14 and 15 and gusset panels 16 have been partially folded about an edge of the cylinder 23, which is defined by fold line 13*a*, between the flaps 14 and 15 and the side panels 11 and corner panels 12. It has been found that the bulk bin of this invention can be expeditiously formed by one workman, merely by placing the cylinder 23 on the floor with its flaps 14 and 15 facing upward, as shown in FIG. 3, and urging the four-sided tapered flaps 15 inwardly and downwardly of the cylinder 23, as shown in FIG. 4. Urging the tapered flaps 15 inwardly and downwardly of the cylinder 23 results in the tapered flaps 15 and rectangular flaps 14 being folded about the fold line 13*a*, with each tapered flap 15 being positioned beneath adjacent rectangular flaps 14. Urging the tapered flaps 15 inwardly and downwardly of the cylinder 23 also causes the triangular gusset panels 16 to fold about the fold lines 13*b* and 13*c*, connecting the gusset panels to the rectangular flaps 14 and tapered flaps 15.

When all of the tapered flaps 15 have been urged inwardly and downwardly of the cylinder 23, past the plane formed by the fold line 13*a*, each rectangular flap 14, tapered flap 15 and triangular gusset panel 16 is surrounded by the side panels 11 and corner panels 12, and the free edges of the flaps 14 and 15 and gusset panels 16 are positioned interiorly of the cylinder 23. This position of the flaps and gusset panels is shown in FIGS. 5 and 6. The flaps and gusset panels, once urged past the plane formed by fold line 13*a*, tend to stay within the cylinder 23.

In FIG. 7 are shown the bottom pad blank 18 of FIG. 2 and the cylinder 23 of FIG. 5, after carrying out a first step for placing the bottom pad 18 in the cylinder to form the bulk bin of this invention. In this first step, the flaps and gusset panels 14, 15 and 16 are pulled outwardly of the cylinder 23, after the flaps and gusset panels have been urged inwardly of the cylinder, past the plane formed by fold line 13*a*, as shown in FIG. 5. Thereby, the flaps and gusset panels 14, 15 and 16 of the cylinder 23 reassume a position, as is shown in FIG. 4. Then, each of the two triangular gusset panels 16*a* and 16*a*', about a first rectangular flap 14', is positioned in the first pair 19 of parallel slots 21, along the first side edge 18*a* of the bottom pad 18. In carrying out this step, the first side edge 18*a* of bottom pad 18 is preferably urged towards fold line 13*a*, connecting the first rectangular flap 14' with a side panel 11, so that the triangular gusset panels 16*a* and 16*a*', connected to the first rectangular flap 14', are inserted, at least part way, into the first pair 19 of parallel slots 21. By so doing, at least a portion of the bottom pad 18, between the first pair 19 of slots 21, is positioned between the pair of triangular gusset panels 16*a* and 16*a*' that are foldably connected to the first rectangular flap 14'.

FIG. 8 shows the bottom pad blank 18 of FIG. 2 and the cylinder 23 of FIG. 5, after carrying out a second step for placing the bottom pad 18 in the cylinder, to form the bulk bin of this invention. In this second step, each of the two triangular gusset panels 16*b* and 16*b*', about a second rectangular flap 14", is positioned in the second pair 20 of parallel slots 21, along the second side edge 18*b* of the bottom pad 18. As seen in FIG. 8, in this step, the second rectangular flap 14" utilized is on the opposite side of the cylinder 23 from the first rectangular flap 14', and the second pair 20 of parallel slots 21 utilized is along the opposite side edge 18*b* of the bottom pad 18 from the first pair 19 of parallel slots 21. In carrying out this step, the second side edge 18*b* of the bottom pad 18 is preferably urged towards the fold line 13*a*, connecting the second rectangular flap 14" to a side panel 11, so that the gusset panels 16*b* and 16*b*', connected to the second rectangular flap 14", are inserted, at least part way, into the second pair 20 of parallel slots 21 in the bottom pad 18. Thereby, at least a portion of the bottom pad 18, between the second pair 20 of slots 21, is positioned between the pair of triangular gusset panels 16*b* and 16*b*' that are foldably connected to the second rectangular flap 14".

Figure 9:
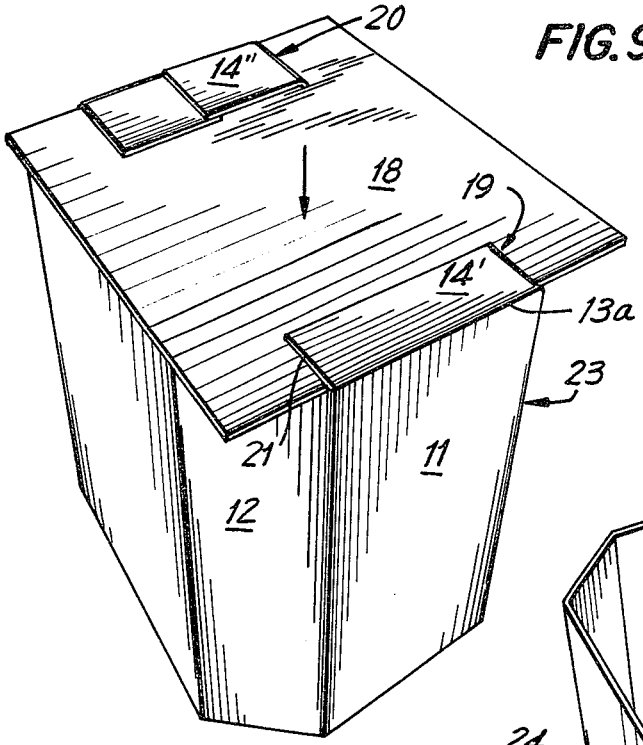
FIG. 9 is a perspective view of the bottom pad of FIG. 2 and the cylinder of FIG. 5, after carrying out a third step for placing the pad in the cylinder to form the bulk bin of this invention.

Shown in FIG. 9 are the bottom pad blank 18 of FIG. 2 and the cylinder 23 of FIG. 5, after carrying out the third and last step for placing the bottom pad 18 in the cylinder to form the bulk bin of this invention. In this third step, the bottom pad 18 is simply urged downwardly or inwardly of the cylinder 23, so that the foldable connections or fold lines 13*b* between the first and second rectangular flaps 14' and 14" and the triangular gusset panel 16*a*, 16*a*', 16*b* and 16*b*', about them, are disposed within the first and second pairs 19 and 20 of parallel slots 21 in the bottom pad 18. By urging the bottom pad 18 inwardly of the cylinder 23, in this way, the first and second rectangular flaps 14' and 14" are also urged inwardly of the cylinder, so that they become substantially coplanar with the fold line 13*a*, between the rectangular and tapered flaps 14 and 15 and the side and corner panels 11 and 12. Also as a result, the portions 22 of the bottom pad 18, between the parallel slots 21 of the first and second pairs 19 and 20 of slots, are disposed between the first and second rectangular flaps 14' and 14" and the gusset panels 16*a*, 16*a*', 16*b* and 16*b*' about them.

Figure 10:
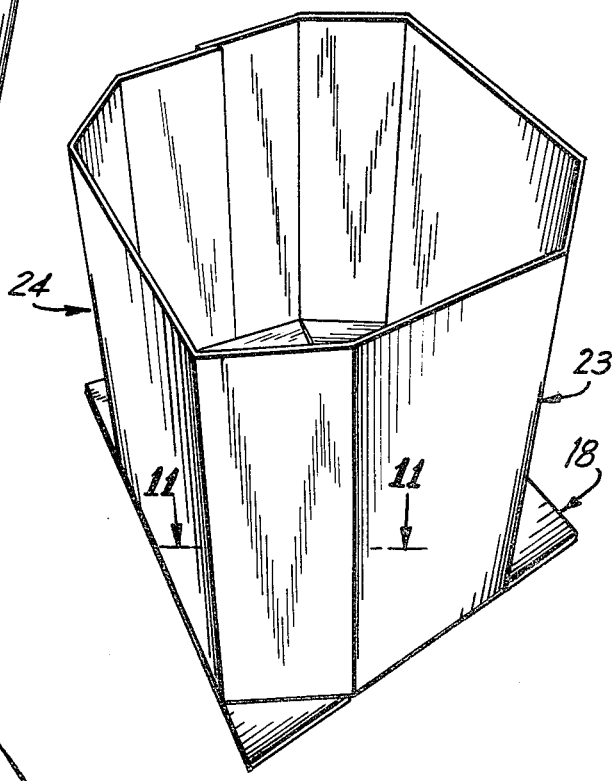
FIG. 10 is a perspective view of the bulk bin of this invention, after the cylinder and bottom pad, shown in FIG. 9, have been inverted.

Shown in FIG. 10 is the paperboard bulk bin, generally 24, of this invention, formed from the bottom pad 18 and the cylinder 23. In FIG. 10, the cylinder 23 and the bottom pad 18 have been inverted, so that the bulk bin 24 rests on the bottom pad 18.

In the bulk bin 24 of this invention, the length and width of the generally rectangular, bottom pad 18 are not critical, provided that the separation of the opposite side edges 18*a* and 18*b* thereof is: (1) significantly greater than the separation of the first and second, rectangular flaps 14' and 14", on opposite sides of the bulk bin 24; but (2) is not greater than the separation of the side panels 11, connected along fold line 13*a* to the first and second rectangular flaps 14' and 14". Preferably, the bottom pad 18 has only four sides and has about the same length and width as the generally tubular cross-section of the side wall of the bulk bin 24 of this invention. In this regard, it is especially preferred: (1) that the bottom pad 18 be substantially square; and (2) that the cross-section of the side wall of the bulk bin 24 form a polygon of four, eight or twelve sides, preferably only eight sides, and have a substantially equal length and width. However, where the side wall of the bulk bin 24 has an eight-or twelve-sided, polygonal cross-section, the corner portions 18*c* of the bottom pad 18 can, if desired, be suitably beveled, so that the bottom pad 18 has nearly the same eight- or twelve-sided configuration as the side wall of the bulk bin.

Figure 11:
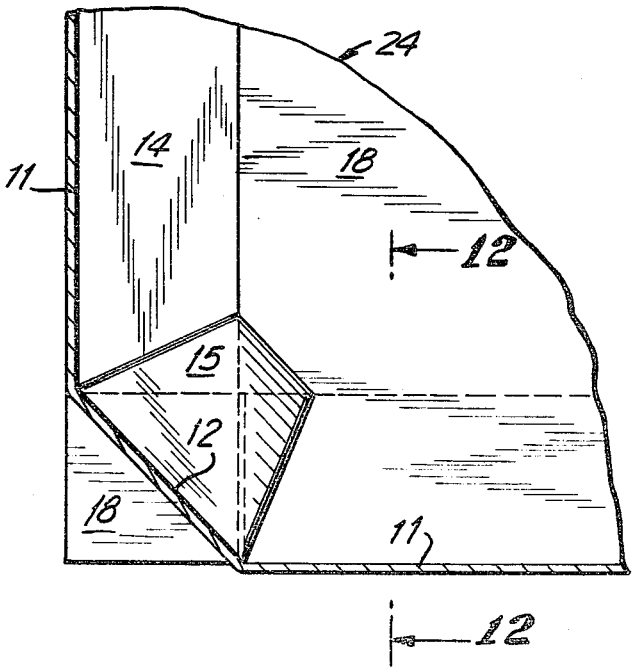
FIG. 11 is a fragmentary sectional view, taken along line 11—11 in FIG. 10.

In combination, the elements of the cylinder 23 and bottom pad 18, as shown in FIGS. 10, 11 and 12, provide a substantially flat-bottomed, stable, bulk bin 24 for relatively heavy loads of meat and the like. The bulk bin 24 stands, without tipping over or bursting, when being loaded with large quantities of meat or when filled and moved on a pallet. In addition, because of the interfolded relationship of the bottom pad 18 and the flaps and gusset panels 14, 15 and 16 of the cylinder 23, the bulk bin 24 maintains its proper tubular shape, even prior to the time that it is filled, and, when filled, it also tends to resist bulging. Moreover, because of the simple way that the bottom pad 18 is inserted in the cylinder 23, as shown in FIGS. 7 to 9, the bulk bin 24 of this invention can be easily assembled by a single workman, without significant difficulties in properly aligning the bottom pad 18 in the cylinder 23 or in maintaining the generally tubular configuration of the bin 24 during its assembly.

It is thought that the invention and many of its attendant advantages will be understood from the foregoing description, and it will be apparent that various changes may be made in the form, construction and arrangement of the parts without departing from the spirit and scope of the invention or sacrificing all of its material advantages, the form hereinbefore described being merely a preferred embodiment thereof.

I claim:

1. In a paperboard bulk bin, provided with: a side wall formed from a plurality of alternating, foldably connected, substantially rectangular, upstanding side panels and corner panels; each of said side panels having a horizontally disposed, substantially rectangular flap, foldably connected to the bottom edge thereof; each of said corner panels having a horizontally disposed, four-sided, tapered flap, foldably connected to the bottom edge thereof and positioned atop adjacent rectangular flaps; and each of said tapered flaps and rectangular flaps being foldably connected to a triangular gusset panel, horizontally disposed between them; the improved bottom pad which comprises:

an unscored, unfolded, generally rectangular, substantially planar, substantially rigid member, having two pairs of parallel slots, extending from opposite side edges thereof;

said pairs of slots being substantially aligned; and the foldable connections between each of two rectangular flaps, on opposite sides of the bin, and the pairs of triangular gusset panels, about each of said two rectangular flaps, being disposed within said slots of said bottom pad, so that the portions of said bottom pad, between each pair of said parallel slots, are between one of said two rectangular flaps and its foldably connected pair of triangular gusset panels.

2. The bin of claim 1 wherein said side panels have substantially the same dimensions, said corner panels have substantially the same dimensions, said rectangular flaps have substantially the same dimensions, said tapered flaps have substantially the same dimensions, and said triangular gusset panels have substantially the same dimensions; and wherein there is an even number of each of said panels and flaps.

3. The bin of claim 2 wherein the cross-section of the side wall of the bin forms a polygon of four, eight or twelve sides.

4. The bin of claim 2 wherein the cross-section of the side wall of the bin forms a polygon of only eight sides.

5. The bin of claim 2 wherein the bottom pad has about the same length and width as the cross-section of the side wall of the bin.

6. The bin of claim 5 wherein the bottom pad has only four sides.

7. The bin of claim 6 wherein the bottom pad is substantially square.

8. The bin of claim 3 wherein the cross-section of the side wall of the bin forms a polygon having a substantially equal length and width.

9. The bin of claim 8 wherein wherein the cross-section of the side wall of the bin forms a polygon having only eight sides.

10. The bin of claim 9 wherein wherein the bottom pad is substantially square.

11. The bin of claim 1 wherein the length of the slots in the bottom pad is about equal to the length of each foldable connection between a rectangular flap and a triangular gusset panel.

* * * * *